US011162736B2

(12) United States Patent
Strömer et al.

(10) Patent No.: US 11,162,736 B2
(45) Date of Patent: Nov. 2, 2021

(54) PLATE PACKAGE, PLATE AND HEAT EXCHANGER DEVICE

(71) Applicant: ALFA LAVAL CORPORATE AB, Lund (SE)

(72) Inventors: Fredrik Strömer, Kävlinge (SE); Anders Skoglösa, Ramlösa (SE)

(73) Assignee: ALFA LAVAL CORPORATE AB, Lund (SE)

( * ) Notice: Subject to any disclaimer, the term of this patent is extended or adjusted under 35 U.S.C. 154(b) by 155 days.

(21) Appl. No.: 16/475,216

(22) PCT Filed: Feb. 15, 2018

(86) PCT No.: PCT/EP2018/053750
§ 371 (c)(1),
(2) Date: Jul. 1, 2019

(87) PCT Pub. No.: WO2018/162199
PCT Pub. Date: Sep. 13, 2018

(65) Prior Publication Data

US 2019/0339017 A1 Nov. 7, 2019

(30) Foreign Application Priority Data

Mar. 10, 2017 (EP) ..... 17160262

(51) Int. Cl.
*F28F 3/04* (2006.01)
*F28D 9/00* (2006.01)
*F28D 21/00* (2006.01)

(52) U.S. Cl.
CPC ..... *F28D 9/0006* (2013.01); *F28D 9/0037* (2013.01); *F28D 9/0043* (2013.01); (Continued)

(58) Field of Classification Search
CPC .... F28D 9/0006; F28D 9/0068; F28D 9/0056; F28D 9/0043; F28D 9/0037; F28F 3/046
(Continued)

(56) References Cited

U.S. PATENT DOCUMENTS 4,836,276 A 6/1989 Yamanaka et al.
5,179,999 A 1/1993 Meekins et al.
(Continued)

FOREIGN PATENT DOCUMENTS

CA 2037093 4/1999
CH 621 623 A5 2/1981
(Continued)

OTHER PUBLICATIONS

English translation of the Japanese Notice of Reasons for Rejection for Japanese Application No. 2019-549005, dated Dec. 7, 2020.
(Continued)

*Primary Examiner* — Paul Alvare
(74) *Attorney, Agent, or Firm* — Birch, Stewart, Kolasch & Birch, LLP

(57) ABSTRACT

A plate package for a heat exchanger device includes a plurality of heat exchanger plates with mating abutment portions forming a fluid distribution element in every second plate interspace thereby forming in the respective second plate interspaces two arc-shaped flow paths wherein a respective one of the two flow paths is divided into at least three flow path sectors arranged one after the other along a respective flow path. A plate and a heat exchanger are also disclosed.

17 Claims, 6 Drawing Sheets

(52) U.S. Cl.
CPC .. *F28D 21/0017* (2013.01); *F28D 2021/0064* (2013.01); *F28F 3/046* (2013.01)

(58) Field of Classification Search
USPC ..... 165/166
See application file for complete search history.

(56) References Cited

U.S. PATENT DOCUMENTS

| | | | | |
|---|---|---|---|---|
| 5,203,832 | A | 4/1993 | Beatenbough et al. | |
| 5,343,936 | A | 9/1994 | Beatenbough et al. | |
| 5,823,253 | A * | 10/1998 | Kontu | F28D 9/0012 165/167 |
| 6,158,238 | A * | 12/2000 | Lampinen | F28D 9/0006 62/484 |
| 7,594,538 | B2 * | 9/2009 | Stenhede | F28D 9/0006 165/157 |
| 8,061,416 | B2 | 11/2011 | Geskes et al. | |
| 8,109,326 | B2 | 2/2012 | Larsson et al. | |
| 8,684,071 | B2 | 4/2014 | Andersson et al. | |
| 8,857,504 | B2 * | 10/2014 | Christensen | F28F 3/046 165/167 |
| 9,038,610 | B2 * | 5/2015 | Meshenky | F28D 9/0043 123/563 |
| 10,234,212 | B2 * | 3/2019 | Noel-Baron | F28D 9/005 |
| 10,286,502 | B2 * | 5/2019 | Henriksson | F28F 11/00 |
| 10,458,713 | B2 * | 10/2019 | Takeda | F28F 3/042 |
| 2005/0039486 | A1 * | 2/2005 | Knoll | F28D 21/0017 62/512 |
| 2005/0039896 | A1 | 2/2005 | Laine et al. | |
| 2006/0191672 | A1 | 8/2006 | Stenhede et al. | |
| 2014/0251579 | A1 | 9/2014 | Sloss | |
| 2015/0096727 | A1 | 4/2015 | Dränkow et al. | |
| 2016/0363391 | A1 * | 12/2016 | Kim | F28D 9/0043 |
| 2018/0128549 | A1 | 5/2018 | Takeda et al. | |

FOREIGN PATENT DOCUMENTS

| | | | | |
|---|---|---|---|---|
| CN | 1636127 | A | 7/2005 | |
| CN | 1842689 | A | 10/2006 | |
| CN | 101983312 | A | 3/2011 | |
| CN | 102084204 | A | 6/2011 | |
| CN | 102308177 | A | 1/2012 | |
| CN | 104296585 | A | 1/2015 | |
| DE | 641 600 | | 2/1937 | |
| EP | 0 275 724 | A1 | 7/1988 | |
| EP | 0 463 298 | B1 | 6/1994 | |
| EP | 0 445 006 | B1 | 7/1994 | |
| EP | 0 616 678 | B1 | 12/1995 | |
| EP | 1 141 645 | B1 | 10/2002 | |
| EP | 1634031 | B1 | 3/2010 | |
| EP | 2 394 129 | A1 | 10/2014 | |
| EP | 1 811 258 | B1 | 12/2014 | |
| EP | 2257759 | B1 | 12/2014 | |
| EP | 2 988 085 | A1 | 2/2016 | |
| EP | 2964942 | B1 | 1/2018 | |
| GB | 391894 | | 5/1933 | |
| GB | 444073 | | 3/1936 | |
| GB | 581742 | | 10/1946 | |
| GB | 1 339 542 | | 12/1973 | |
| GB | 2 174 488 | A | 11/1986 | |
| JP | 7-190665 | A | 7/1995 | |
| JP | 2006-527835 | A | 12/2006 | |
| JP | 2012-516990 | A | 7/2012 | |
| JP | 2016-515180 | A | 5/2016 | |
| JP | 2016-148491 | A | 8/2016 | |
| KR | 10-1345733 | B1 | 12/2013 | |
| SE | 105870 | | 11/1942 | |
| WO | WO 99/30099 | A1 | 6/1999 | |
| WO | WO 03/056267 | A1 | 7/2003 | |
| WO | WO 2004/111564 | A1 | 12/2004 | |
| WO | WO 2006/120371 | A1 | 11/2006 | |
| WO | WO 2010/090557 | A1 | 8/2010 | |
| WO | WO-2010090557 | A1 * | 8/2010 | F28F 3/046 |
| WO | WO 2013/144251 | A1 | 10/2013 | |
| WO | WO 2016/199562 | A1 | 12/2016 | |

OTHER PUBLICATIONS

English translation of the Korean Office Action, dated Sep. 28, 2020, for Korean Application No. 10-2019-7029215.
International Search Report, issued in PCT/EP2018/053750, dated Jul. 17, 2018.
Written Opinion of the International Searching Authority, issued in PCT/EP2018/053750, dated Jul. 17, 2018.
English translations of the Chinese Office Action and Search Report, dated Jul. 30, 2020, for Chinese Application No. 201880016961.8.

* cited by examiner

*Fig. 5*
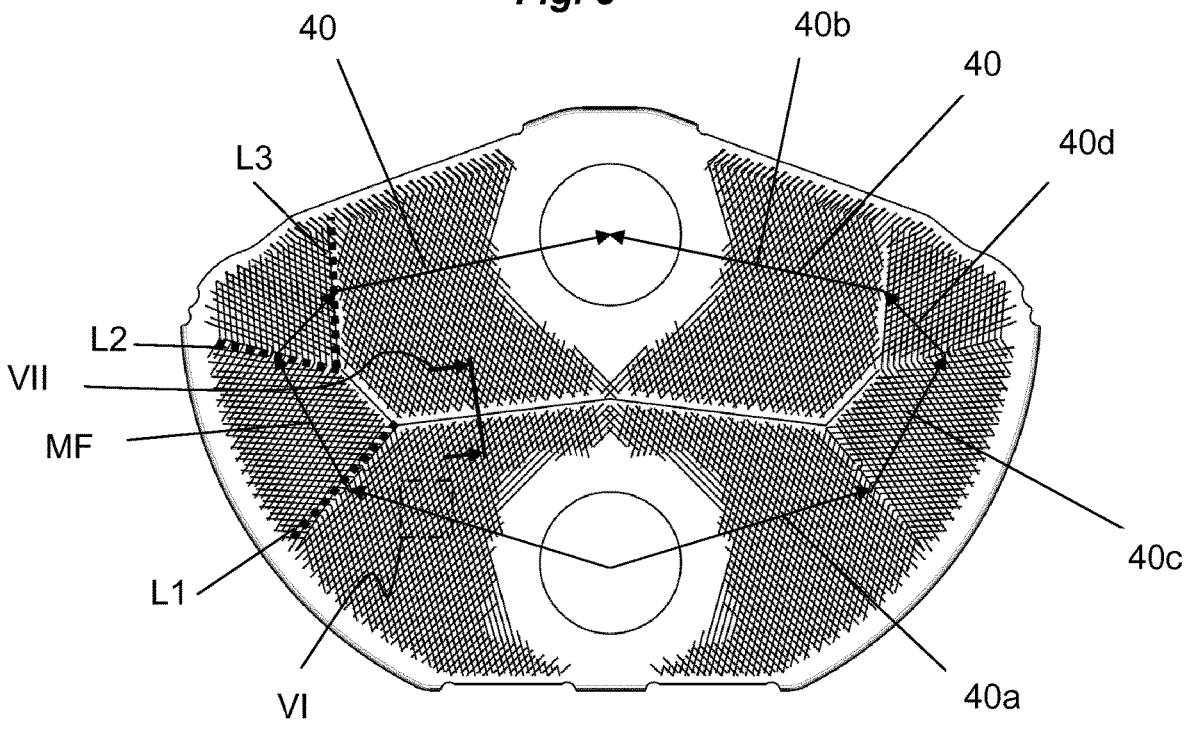
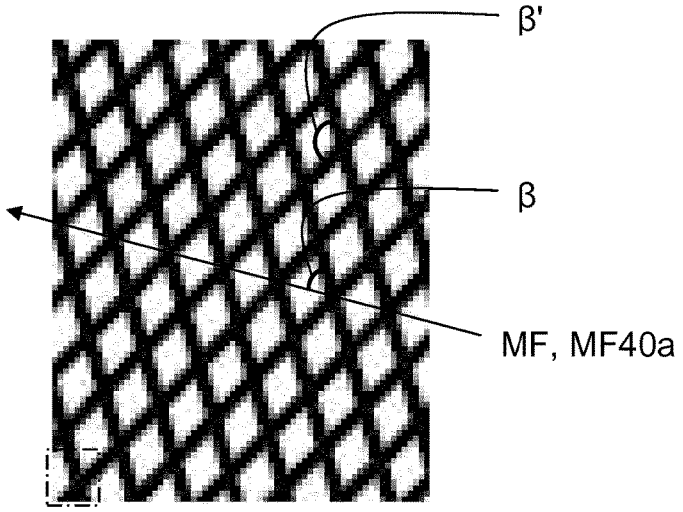
*Fig. 6*

PLATE PACKAGE, PLATE AND HEAT EXCHANGER DEVICE

FIELD OF INVENTION

The invention relates to a plate package for a heat exchanger device. The invention also relates to a plate for a heat exchanger device. The invention also relates to a heat exchanger device.

TECHNICAL BACKGROUND

Heat exchanger devices are well known for evaporating various types of cooling medium such as ammonia, freons, etc., in applications for generating e.g. cold. The evaporated medium is conveyed from the heat exchanger device to a compressor and the compressed gaseous medium is thereafter condensed in a condenser. Thereafter the medium is permitted to expand and is recirculated to the heat exchanger device. One example of such heat exchanger device is a heat exchanger of the plate-and-shell type.

One example of a heat exchanger of the plate-and-shell type is known from WO2004/111564 which discloses a plate package composed of substantially half-circular heat exchanger plates. The use of half-circular heat exchanger plates is advantageous since it provides a large volume inside the shell in the area above the plate package, which volume improves separation of liquid and gas. The separated liquid is transferred from the upper part of the inner space to a collection space in the lower part of the inner space via an interspace. The interspace is formed between the inner wall of the shell and the outer wall of the plate package. The interspace is part of a thermo-syphon loop which sucks the liquid towards the collection space of the shell.

When designing heat exchangers there is typically a plurality of design criteria to consider and to balance. The heat exchanger should have an efficient heat transfer and it should typically be compact and of robust design. Moreover, the respective plates should be easy and cost-effective to manufacture.

SUMMARY OF INVENTION

It is an object of the invention to provide a plate package capable of providing efficient heat transfer and which may used in designing a compact heat exchanger. Moreover, it is also an object of the invention to provide a design by which the plates of the plate package may be produced in a convenient and cost-efficient manner.

These objects have been achieved by a plate package for a heat exchanger device, wherein the plate package includes a plurality of heat exchanger plates of a first type and a plurality of heat exchanger plates of a second type arranged alternatingly in the plate package one on top of the other, wherein each heat exchanger plate has a geometrical main extension plane and is provided in such a way that the main extension plane is substantially vertical when installed in the heat exchanger device, wherein the alternatingly arranged heat exchanger plates form first plate interspaces, which are substantially open and arranged to permit a flow of a medium to be evaporated there-through, and second plate interspaces, which are closed and arranged to permit a flow of a fluid for evaporating the medium, wherein each of the heat exchanger plates of the first type and of the second type has a first port opening at a lower portion of the plate package and a second port opening at an upper portion of the plate package, the first and second port openings being in fluid connection with the second plate interspaces, wherein the heat exchanger plates of the first type and of the second type further comprise mating abutment portions forming a fluid distribution element in the respective second plate interspaces, wherein the fluid distribution element has a longitudinal extension having mainly a horizontal extension along a horizontal plane and being located as seen in a vertical direction in a position between the first port openings and the second port openings, thereby forming in the respective second plate interspaces two arc-shaped flow paths extending from the first port opening, around the fluid distribution element, and to the second port opening, or vice versa, and, wherein respective one of the two flow paths is divided into at least three flow path sectors arranged one after the other along respective flow path, wherein each of the heat exchanger plates of the first type and of the second type in each flow path sector comprises a plurality of mutually parallel ridges, wherein the ridges of the heat exchanger plates of the first and second types are oriented such that when they abut each other they form a chevron pattern relative to a main flow direction in the respective flow path sector, wherein respective ridge form an angle β being greater than 45° to the main flow direction in respective flow path sector, wherein at least a first of the at least three flow path sectors is arranged in the lower portion of the plate package, at least a second of the at least three flow path sectors is arranged in the upper portion of the plate package, and at least a third of the at least three flow path sectors is arranged in a transition between the upper and lower portions.

The fluid distribution element in the respective second plate interspaces may be said to constitute a virtual division between the upper and lower portions of the plate package.

By designing the plate package in accordance with the above, which in short may be said to relate to; providing at least three flow paths sectors, by positioning them in the lower portion, upper portion and in the transition portion, and by specifically orienting the ridges in the respective flow path sector, it is possible to secure that the flow of the fluid in the respective flow path in the respective second interspace is spread over the full width of the respective flow path. Thereby an efficient use of the complete plate area is achieved. Especially, by providing at least three flow path sectors and by positioning at least one flow path sector in the transition between the upper and lower portions, it is possible to provide a spreading of the fluid towards the outer edges of the plate also in the area where the flow path extends around the outer ends of the fluid distribution element.

The feature, wherein respective ridge form an angle β being greater than 45° relative to the main flow direction in respective flow path sector, may alternatively be phrased as; wherein the abutting ridges together form a chevron angle β' being greater than 90°, the chevron angle being measured from ridge of one plate to ridge of the other plate inside the chevron shape.

The angle β is preferably greater than 50° and is more preferably greater than 55°. The chevron angle β' is preferably greater than 100° and is more preferably greater than 110°.

Each flow path may be divided into at least four sectors wherein at least two of the at least four flow path sectors are arranged in the transition between the upper and lower portions. This further improves the spreading of the fluid towards the outer edges of the plate also in the area where the flow path extends around the outer ends of the fluid distribution element.

The fluid distribution element may comprise a mainly horizontally extending central portion and two wing portions extending upwardly and outwardly from either end of the central portion. This further improves the spreading of the fluid towards the outer edges of the plate also in the area where the flow path extends around the outer ends of the fluid distribution element.

The fluid distribution element may be continuously curved or formed of rectilinear interconnected segments or a combination thereof.

The fluid distribution element is mirror symmetrical about a vertical plane extending transversely to the main extension planes and through centres of the first and second port openings. This is advantageous since it facilitates manufacture of the plates and since it will provide a symmetric heat transfer load.

Respective demarcation line between adjoining sectors may extend from the fluid distribution element outwardly, preferably rectilinearly, towards an outer edge of the respective heat exchanger plate. Preferably, respective demarcation line extends completely through the flow path.

Preferably, the main flow direction in the first sector extends from the inlet port to a central portion of a demarcation line between the first sector and an adjoining downstream sector, wherein respective main flow direction in a sector extends from a central portion of respective demarcation line between the sector and an adjoining upstream sector to a central portion of respective demarcation line between the sector and an adjoining downstream sector, wherein the main flow direction in the second sector extends from a central portion of the demarcation line between the second sector and an adjoining upstream sector to the outlet port, and wherein the central portion of respective demarcation line comprises a mid-point of respective demarcation line and up to 15%, preferably up to 10%, of the length of the respective demarcation line on either side of the mid-point.

With these main flow directions in respective flow path sector in combination with the orientation of the mutually parallel ridges of respective flow path sector, a good spreading of the flow is provided along the whole length of the flow path.

Between two adjacent flow path sectors having ridges extending at an angle relative to each other, a first transition ridge may be formed, in either the plates of the first or the second type, as a stem branching off into two legs. Such a design is useful when the angle between the ridges is comparably small such as smaller than 40°, and the design is especially useful when the angle is smaller than 30°, or even smaller than 25°. By providing a transition ridge with a stem branching off into two legs it is possible to provide a ridge which is capable of securely abutting the ridges of the adjacent plate and which may maintain the ridge pattern with a minimum of deviation from the ridge pattern of respective flow path sector. Moreover, it is difficult to press shapes having small radius. Thus, by providing a transition ridge of this kind, it is possible to use large radiuses by allowing the two legs transfer into a stem when the distance between the two legs becomes too small to provide room for a sufficiently large radius of the pressing tool.

The stem may abut a plurality, preferably at least three, consecutive chevron shaped ridge transitions of the other one of the first or second type of plates, the ridge transitions being formed between the two adjacent flow path sectors having ridges extending at an angle relative to each other. This allows for a strong abutment between the plates even when the angle between the ridges of respective flow path sector is small.

At least one of the two legs and/or the stem may along its longitudinal extension have a portion with a locally enlarged width as seen in a direction transverse the longitudinal extension. This may be used to minimise any deviation from the ridge pattern of respective flow path sector.

The first leg may extend in parallel with the ridges of its adjacent sector and the second leg may extend in parallel with the ridges of its adjacent sector. This way any deviation from the ridge pattern of respective flow path sector is minimised.

A second transition ridge may be formed as a stem which preferably branches off into two legs, wherein the stem of the second transition ridge is arranged between the two legs of the first transition ridge. In a design with the second transition ridge having a stem branching off into two legs, the first and second transition ridges are oriented in the same direction. It may be said that the first and second transition ridges in a sense look like arrows pointing in the same direction. By providing a second transition ridge positioned like this, it is possible to provide a smooth transition also for cases with the demarcation line is of significant length compared to the ridge to ridge distances. It may be noted that also the second transition ridge may be designed according to the design specified in relation to the first transition ridge above.

A specific problem also addressed is that it is difficult to press shapes having small radius. This problem is addressed by a plate for a heat exchanger device, such as a plate heat exchanger, the plate comprising a first sector with mutually parallel ridges and an adjoining second sector with mutually parallel ridges extending at an angle relative to the ridges of the first sector, the plate further comprising at least one transition ridge formed as a stem branching off into two legs. By providing a transition ridge of this kind, it is possible to use large radiuses by allowing the two legs transfer into a stem when the distance between the two legs becomes too small to provide room for a sufficiently large radius of the pressing tool.

The angle between the ridges, i.e. between the ridges of the first sector and the ridges of the adjoining second sector, may be smaller than 40°, such as smaller than 30°, such as smaller than 25°.

The stem may have a length exceeding twice, preferable thrice, a distance from ridge to ridge of the mutually parallel ridges of the first sector and of the second sector. This may be used to secure that the stem abuts a plurality, preferably at least three, consecutive chevron shaped ridge transitions of the other one of the first or second type of plates, the ridge transitions being formed between the two adjacent flow path sectors having ridges extending at an angle relative to each other. This allows for a strong abutment between the plates even when the angle between the ridges of respective flow path sector is small.

At least one of the two legs and/or the stem may along its longitudinal extension have a portion with a locally enlarged width as seen in a direction transverse the longitudinal extension. This may be used to minimise any deviation from the ridge pattern of respective flow path sector.

The first leg may extend in parallel with the ridges of its adjacent sector and the second leg may extend in parallel with the ridges of its adjacent sector.

A second transition ridge may be formed as a stem which preferably branches off into two legs, wherein the stem of the second transition ridge is arranged between the two legs of the first transition ridge. By providing a second transition ridge positioned like this, it is possible to provide a smooth transition also for cases with the demarcation line is of significant length compared to the ridge to ridge distances. It may be noted that also the second transition ridge may be designed according to the design specified in relation to the first transition ridge above.

The above mentioned object concerning efficient heat transfer has also been achieved by a heat exchanger device including a shell which forms a substantially closed inner space, wherein the heat exchanger device comprises a plate package including a plurality of heat exchanger plates of a first type and a plurality of heat exchanger plates of a second type arranged alternatingly in the plate package one on top of the other, wherein each heat exchanger plate has a geometrical main extension plane and is provided in such a way that the main extension plane is substantially vertical when installed in the heat exchanger device, wherein the alternatingly arranged heat exchanger plates form first plate interspaces, which are substantially open and arranged to permit a flow of a medium to be evaporated there-through, and second plate interspaces, which are closed and arranged to permit a flow of a fluid for evaporating the medium, wherein each of the heat exchanger plates of the first type and of the second type has a first port opening at a lower portion of the plate package and a second port opening at an upper portion of the plate package, the first and second port openings being in fluid connection with the second plate interspaces, wherein the heat exchanger plates of the first type and of the second type further comprise mating abutment portions forming a fluid distribution element in the respective second plate interspaces, wherein the fluid distribution element has a longitudinal extension having mainly a horizontal extension along a horizontal plane and being located as seen in a vertical direction in a position between the first port openings and the second port openings, thereby forming in the respective second plate interspaces two arc-shaped flow paths extending from the first port opening, around the fluid distribution element, and to the second port opening, or vice versa, and, wherein respective one of the two flow paths is divided into at least three flow path sectors arranged one after the other along respective flow path, wherein each of the heat exchanger plates of the first type and of the second type in each flow path sector comprises a plurality of mutually parallel ridges, wherein the ridges of the heat exchanger plates of the first and second types are oriented such that when they abut each other they form a chevron pattern relative to a main flow direction in the respective flow path sector, wherein respective ridge form an angle β being greater than 45° to the main flow direction in respective flow path sector, wherein at least a first of the at least three flow path sectors is arranged in the lower portion of the plate package, at least a second of the at least three flow path sectors is arranged in the upper portion of the plate package, and at least a third of the at least three flow path sectors is arranged in a transition between the upper and lower portions.

The advantages with this design has been discussed in detail with reference to the plate package and reference is made thereto.

In accordance with one aspect, the invention may in short be said to relate to a plate package for a heat exchanger device including a plurality of heat exchanger plates with mating abutment portions forming a fluid distribution element in every second plate interspace thereby forming in the respective second plate interspaces two arc-shaped flow paths, wherein respective one of the two flow paths is divided into at least three flow path sectors arranged one after the other along respective flow path.

BRIEF DESCRIPTION OF THE DRAWINGS

The invention will by way of example be described in more detail with reference to the appended schematic drawings, which shows a presently preferred embodiment of the invention.

FIG. 5 is a plan view of the plate of FIG. 3 also disclosing the ridge pattern of a second plate abutting the ridges of the plate of FIG. 3-4.

FIG. 6 is an enlargement of the boxed section marked as VI in FIG. 5.

DETAILED DESCRIPTION OF PREFERRED EMBODIMENTS

Figure 1:
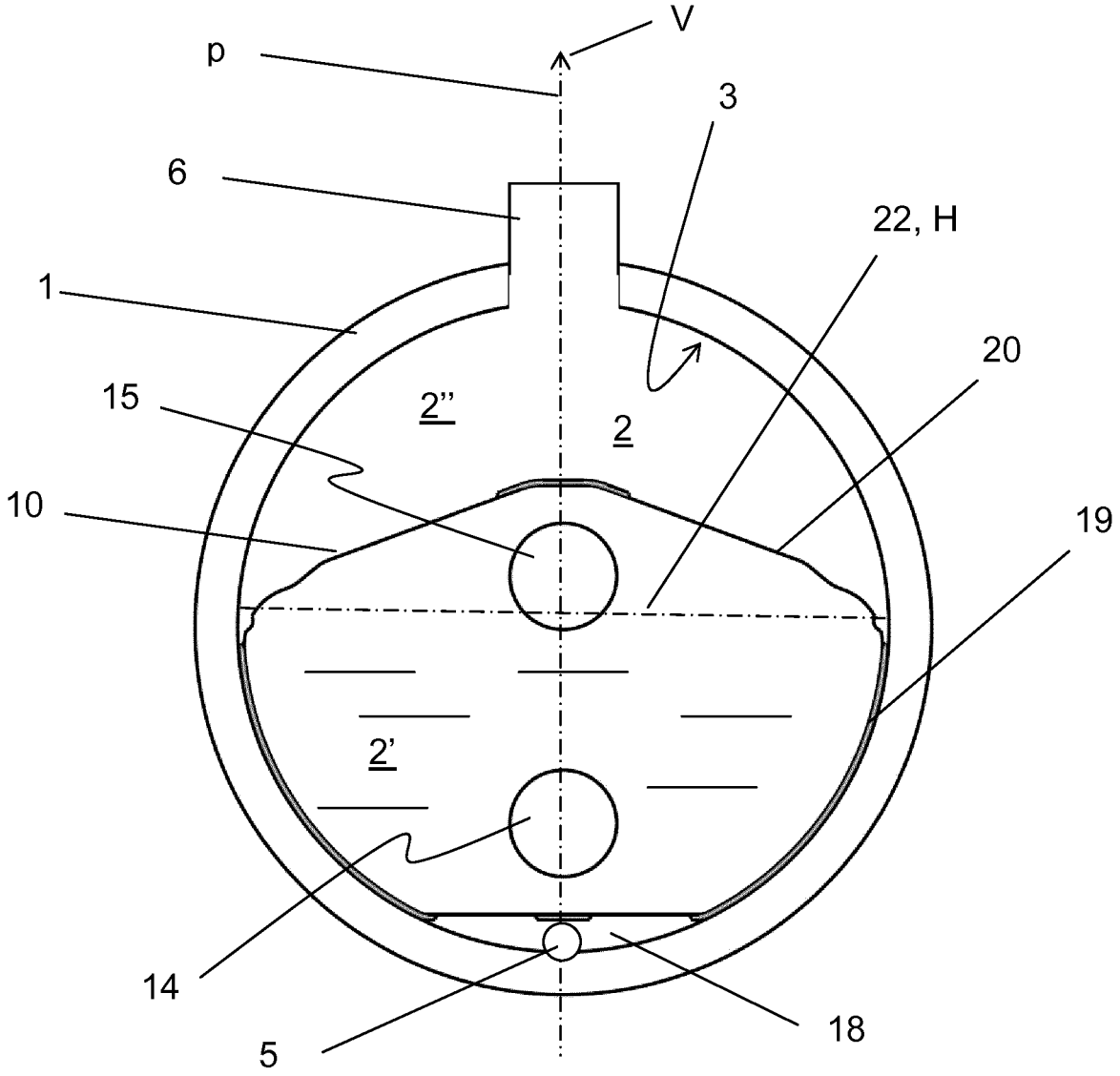
FIG. 1 discloses a schematical and sectional view from the side of a heat exchanger device according to an embodiment of the invention.
Figure 2:
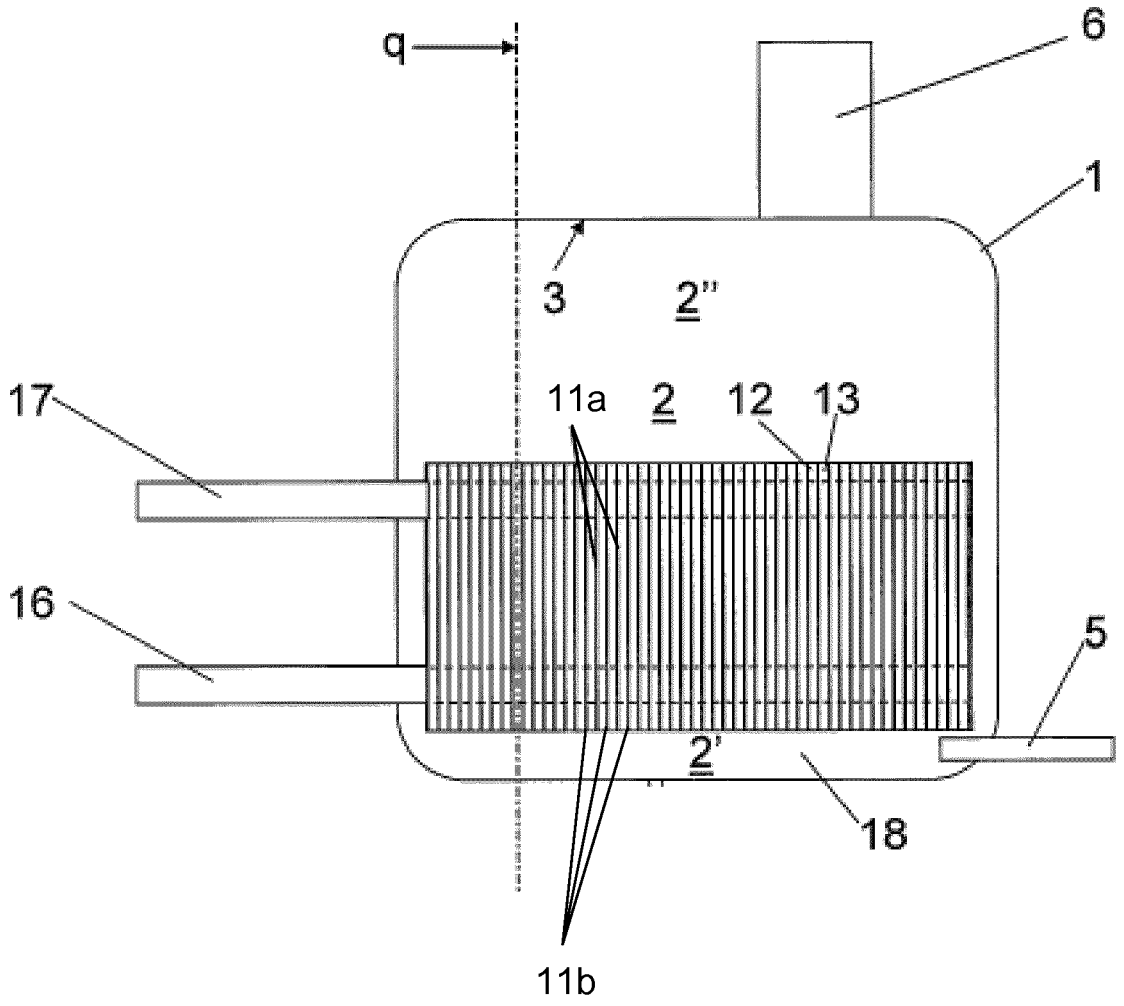
FIG. 2 discloses schematically another sectional view of the heat exchanger device in FIG. 1.

Referring to FIGS. 1 and 2, a schematic cross section of a typical heat exchanger device of the plate-and-shell type is disclosed. The heat exchanger device includes a shell 1, which forms a substantially closed inner space 2. In the embodiment disclosed, the shell 1 has a substantially cylindrical shape with a substantially cylindrical shell wall 3, see FIG. 1, and two substantially plane end walls (as shown in FIG. 2). The end walls may also have a semi-spherical shape, for instance. Also other shapes of the shell 1 are possible. The shell 1 comprises a cylindrical inner wall surface 3 facing the inner space 2. A sectional plane p extends through the shell 1 and the inner space 2. The shell 1 is arranged to be provided in such a way that the sectional plane p is substantially vertical. The shell 1 may by way of example be of carbon steel.

The shell 1 includes an inlet 5 for the supply of a two-phase medium in a liquid state to the inner space 2, and an outlet 6 for the discharge of the medium in a gaseous state from the inner space 2. The inlet 5 includes an inlet conduit which ends in a lower part space 2' of the inner space 2. The outlet 6 includes an outlet conduit, which extends from an upper part space 2" of the inner space 2. In applications for generation of cold, the medium may by way of example be ammonia.

The heat exchanger device includes a plate package 10, which is provided in the inner space 2 and includes a plurality of heat exchanger plates 11*a*, 11*b* provided adjacent to each other. The heat exchanger plates 11*a*, 11*b* are discussed in more detail in the following with reference in FIG. 3. The heat exchanger plates 11 are permanently connected to each other in the plate package 10, for instance through welding, brazing such as copper brazing, fusion bonding, or gluing. Welding, brazing and gluing are well-known techniques and fusion bonding can be performed as described in WO 2013/144251 A1. The heat exchanger plates may be made of a metallic material, such as a iron, nickel, titanium, aluminum, copper or cobalt based material, i.e. a metallic material (e.g. alloy) having iron, nickel, titanium, aluminum, copper or cobalt as the main constituent. Iron, nickel, titanium, aluminum, copper or cobalt may be the main constituent and thus be the constituent with the greatest percentage by weight. The metallic material may have a content of iron, nickel, titanium, aluminum, copper or cobalt of at least 30% by weight, such as at least 50% by weight, such as at least 70% by weight. The heat exchanger plates 11 are preferably manufactured in a corrosion resistant material, for instance stainless steel or titanium.

Figure 4:
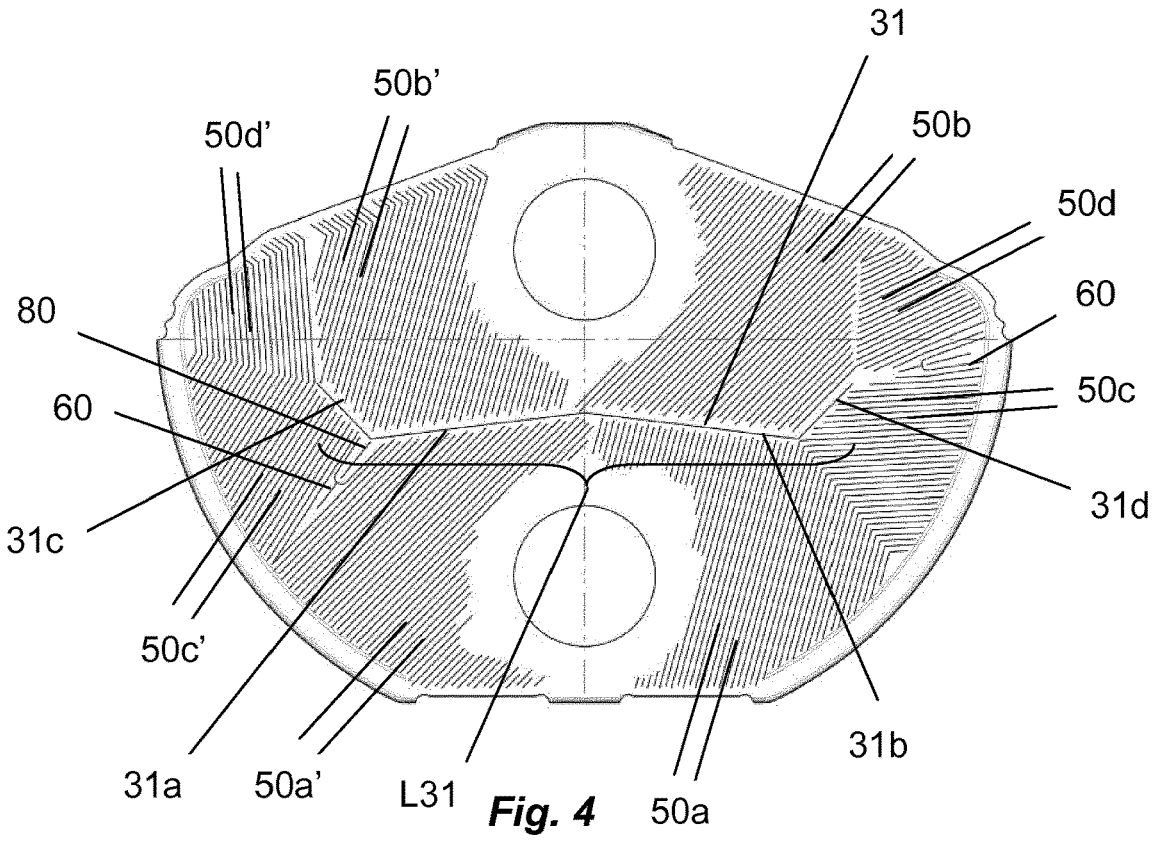
FIG. 4 is a plan view of the plate of FIG. 3.

Each heat exchanger plate 11*a*, 11*b* has a main extension plane q and is provided in such a way in the plate package 10 and in the shell 1 that the extension plane q is substantially vertical and substantially perpendicular to the sectional plane p. The sectional plane p also extends transversally through each heat exchanger plate 11*a*, 11*b*. In the embodiment is disclosed, the sectional plane p also thus forms a vertical centre plane through each individual heat exchanger plate 11*a*, 11*b*. Plane q may also be explained as being a plane parallel to the plane of the paper onto which e.g. FIG. 4 is drawn.

The heat exchanger plates 11*a*, 11*b* form in the plate package 10 first interspaces 12, which are open towards inner space 2, and second plate interspaces 13, which are closed towards the inner space 2. The medium mentioned above, which is supplied to the shell 1 via the inlet 5, thus pass into the plate package 10 and into the first plate interspaces 12.

Each heat exchanger plate 11*a*, 11*b* includes a first port opening 14 and a second port opening 15. The first port openings 14 form an inlet channel connected to an inlet conduit 16. The second port openings 15 form an outlet channel connected to an outlet conduit 17. It may be noted that in an alternative configuration, the first port openings 14 form an outlet channel and the second port openings 15 form an inlet channel. The sectional plane p extends through both the first port opening 14 and the second port opening 15. The heat exchanger plates 11 are connected to each other around the port openings 14 and 15 in such a way that the inlet channel and the outlet channel are closed in relation to the first plate interspaces 12 but open in relation to the second plate interspaces 13. A fluid may thus be supplied to the second plate interspaces 13 via the inlet conduit 16 and the associated inlet channel formed by the first port openings 14, and discharged from the second plate interspaces 13 via the outlet channel formed by the second port openings 14 and the outlet conduit 17.

As is shown in FIG. 1, the plate package 10 has an upper side and a lower side, and two opposite transverse sides. The plate package 10 is provided in the inner space 2 in such a way that it substantially is located in the lower part space 2' and that a collection space 18 is formed beneath the plate package 10 between the lower side of the plate package and the bottom portion of the inner wall surface 3.

Furthermore, recirculation channels 19 are formed at each side of the plate package 10. These may be formed by gaps between the inner wall surface 3 and the respective transverse side or as internal recirculation channels formed within the plate package 10.

Each heat exchanger plate 11 includes a circumferential edge portion 20 which extends around substantially the whole heat exchanger plate 11 and which permits said permanent connection of the heat exchanger plates 11 to each other. These circumferential edge portions 20 will along the transverse sides abut the inner cylindrical wall surface 3 of the shell 1. The recirculation channels 19 are formed by internal or external gaps extending along the transverse sides between each pair of heat exchanger plates 11. It is also to be noted that the heat exchanger plates 11 are connected to each other in such a way that the first plate interspaces 12 are closed along the transverse sides, i.e. towards the recirculation channels 19 of the inner space 2.

The embodiment of the heat exchanger device disclosed in this application may be used for evaporating a two-phase medium supplied in a liquid state via the inlet 5 and discharged in a gaseous state via the outlet 6. The heat necessary for the evaporation is supplied by the plate package 10, which via the inlet conduit 16 is fed with a fluid for instance water that is circulated through the second plate interspaces 13 and discharged via the outlet conduit 17. The medium, which is evaporated, is thus at least partly present in a liquid state in the inner space 2. The liquid level may extend to the level 22 indicated in FIG. 1. Consequently, substantially the whole lower part space 2' is filled by medium in a liquid state, whereas the upper part space 2" contains the medium in mainly the gaseous state.

Figure 3:
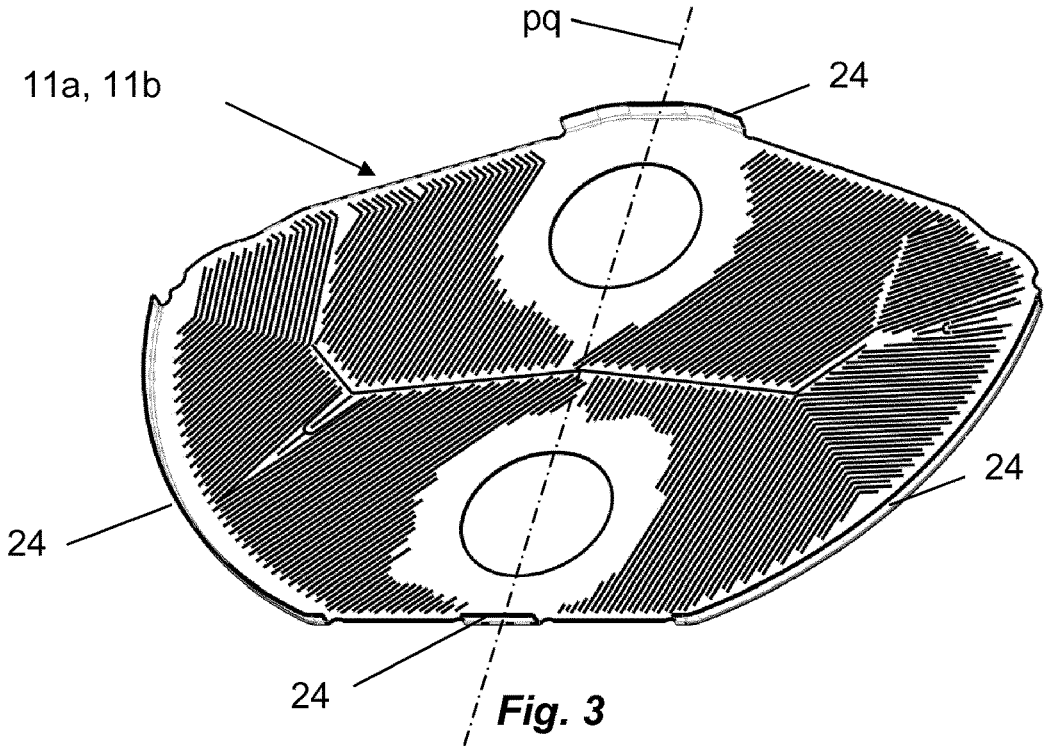
FIG. 3 discloses in perspective view an embodiment of a heat exchanger plate forming part of the plate package.

The heat exchanger plates 11*a* may be of the kind disclosed in FIG. 3. The heat exchanger plates 11*b* may also be of the kind disclosed in FIG. 3 but 180° about the line pq forming the intersection between the sectional plane p and the main extension plane q. Alternatively, the second heat exchanger plate 11*b* may be similar to the heat exchanger plate 11*a* but with all or some of the upright standing flanges 24 removed. It may also be noted that around the port openings 14, 15 there is provided a distribution pattern surrounding each port opening 14, 15 on the second interspace side 13. However, since such patterns are well-known in the art and since it does not form part of the invention, it is for clarity reasons omitted in the drawings.

It may also be noted that through-out the description features of the plates 11*a*, 11*b* will often be discussed without specific reference to whether the feature is formed in the plates 11*a* of the first type or in the plates 11*b* of the second type, since in many cases a specific feature is provided by an interaction or abutment between the plates and the feature as such could be formed in either of the plates or partly in both plates.

As mentioned above, the plate package 10 includes a plurality of heat exchanger plates 11*a* of a first type and a plurality of heat exchanger plates 11*b* of a second type arranged alternatingly in the plate package 10 one on top of the other (as e.g. shown in FIG. 2). Each heat exchanger plate 11*a*, 11*b* has a geometrical main extension plane q and is provided in such a way that the main extension plane q is substantially vertical when installed in the heat exchanger device (as shown in FIG. 1 and FIG. 2). The alternatingly arranged heat exchanger plates 11*a*, 11*b* form first plate interspaces 12, which are substantially open and arranged to permit a flow of a medium to be evaporated there-through, and second plate interspaces 13, which are closed and arranged to permit a flow of a fluid for evaporating the medium.

Each of the heat exchanger plates 11*a*, 11*b* of the first type and of the second type has a first port opening 14 at a lower portion of the plate package 10 and a second port opening 15 at an upper portion of the plate package 10, the first and second port openings 14, 15 being in fluid connection with the second plate interspaces 13.

Figure 7:
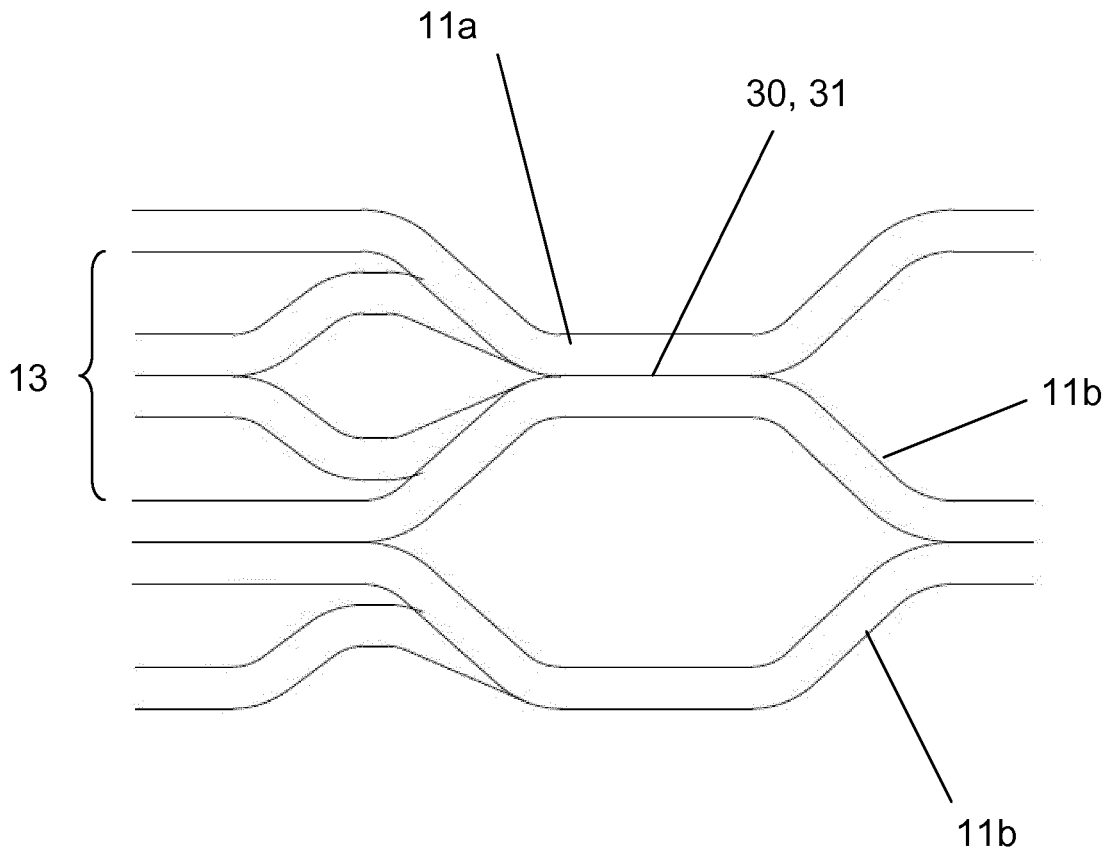
FIG. 7 is a cross-section along the line marked VII in FIG. 5.

The heat exchanger plates 11*a*, 11*b* of the first type and of the second type further comprise mating abutment portions 30 forming a fluid distribution element 31 in the respective second plate interspaces 13. The mating abutment portions 30 may e.g. be formed as a ridge 30 extending upwardly in the plate 11*a* shown in FIG. 3 which interacts with a corresponding ridge of the abutting plate 11*b* formed by turning the plate 11*a* 180° about the line pq, thereby giving the abutment shown in FIG. 7.

The fluid distribution element 31 has a longitudinal extension L31 having mainly a horizontal extension along a horizontal plane H and being located as seen in a vertical direction V in a position between the first port openings 14 and the second port openings 15, thereby forming in the respective second plate interspaces 13 two arc-shaped flow paths 40 extending from the first port opening 14, around the fluid distribution element 31, and to the second port opening 15, or vice versa.

Respective one of the two flow paths 40 is divided into at least three flow path sectors 40*a*, 40*b*, 40*c*, 40*d* arranged one after the other along respective flow path 40.

Each of the heat exchanger plates 11*a*, 11*b* of the first type and of the second type in each flow path sector 40*a-d* comprises a plurality of mutually parallel ridges 50*a-d*, 50*a'-d'*.

The ridges 50*a-d*, 50*a'-d'* of the heat exchanger plates 11*a*, 11*b* of the first and second types are oriented (see FIG. 4) such that when they abut each other (as shown in FIG. 5 and the enlargement in FIG. 6) they form a chevron pattern relative to a main flow direction MF in the respective flow path sector 40*a-d*, wherein respective ridge form an angle β being greater than 45° to the main flow direction MF in respective flow path sector 40*a-d*. The main flow directions MF of respective flow path sector is indicated by the four arrows in each flow path as shown in FIG. 5.

It may be noted that the ridges 50*a* in the first sector 40*a* on the right hand side of the plate is oriented differently than the ridges 50*a'* in the first sector 40*a'* on the left hand side. When every second plate is rotated 180° about the line pq, the ridges 50*a'* will abut the ridges 50*a* and thereby form the above mentioned chevron pattern. As shown in FIG. 5, the corresponding applies to the ridges 50*b-d* on the right hand side and the ridges 50*b'-d'* on the left hand side in FIG. 4.

The feature, wherein respective ridge forms an angle β being greater than 45° relative to the main flow direction in respective flow path sector, may alternatively be phrased as; wherein the abutting ridges together form a chevron angle β' being greater than 90°, the chevron angle being measured from ridge of one plate to ridge of the other plate inside the chevron shape.

The angle β is preferably greater than 50° and is more preferably greater than 55°. The chevron angle β' is preferably greater than 100° and is more preferably greater than 110°.

As shown in FIG. 5 is at least a first 40*a* of the flow path sectors 40*a-d* arranged in the lower portion of the plate package 10, at least a second 40*b* of the path sectors 40*a-d* is arranged in the upper portion of the plate package 10, and at least a third 40*c* and preferably also a fourth 40*d* of the flow path sectors 40*a-d* is arranged in a transition between the upper and lower portions.

The fluid distribution element 31 comprises a mainly horizontally extending central portion 31*a-b* and two wing portions 31*c*, 31*d* extending upwardly and outwardly from either end of the central portion 31*a-b*.

It may be noted that the distribution element 31 basically acts as a barrier in the second plate interspaces 13. However, the fluid distribution element 31 may be provided with small openings e.g. in the corners between the central portion 31*a*, 31*b* and the wing portions 31*c*, 31*d*. Such openings may e.g. be used as drainage openings.

The fluid distribution element 31 is mirror symmetrical about a vertical plane p extending transversely to the main extension planes q and through centres of the first and second port openings 14, 15.

Respective demarcation line L1, L2, L3 between adjoining sectors 40*ad* extends from the fluid distribution element 31 outwardly, preferably rectilinearly, towards an outer edge of the respective heat exchanger plate 11*a-b*. It may be noted that the demarcation lines L1, L2, L3 extends completely through the flow path area 40*a-d*. The white area outside the chevron pattern may be used to provide internal recirculation channels 19

The main flow direction MF in the first sector 40*a* extends from the inlet port 14 to a central portion of a demarcation line L1 between the first sector 40*a* and the adjoining downstream sector 40*c*.

Respective main flow direction MF in a sector, such as sector 40*c* extends from a central portion of respective demarcation line L1 between the sector 40*c* and an adjoining upstream sector 40*a* to a central portion of respective demarcation line L2 between the sector 40*c* and an adjoining downstream sector 40*d*.

The main flow direction MF in the second sector 40*b* extends from a central portion of the demarcation line L3 between the second sector 40*b* and an adjoining upstream sector 40*d* to the outlet port 15.

The central portion of respective demarcation line L1, L2, L3 comprises a mid-point of respective demarcation line and up to 15%, preferably up to 10%, of the length of the respective demarcation line on either side of the mid-point. In the embodiment shown in the figures, the respective main flow direction MF in a sector extends substantially from a mid-point of respective demarcation line between the sector and an adjoining upstream sector substantially to a mid-point of respective demarcation line between the sector and an adjoining downstream sector.

It may be noted that the flow may be in the opposite direction when the port 15 forms and inlet port and port 14 forms an outlet port.

Figure 8:
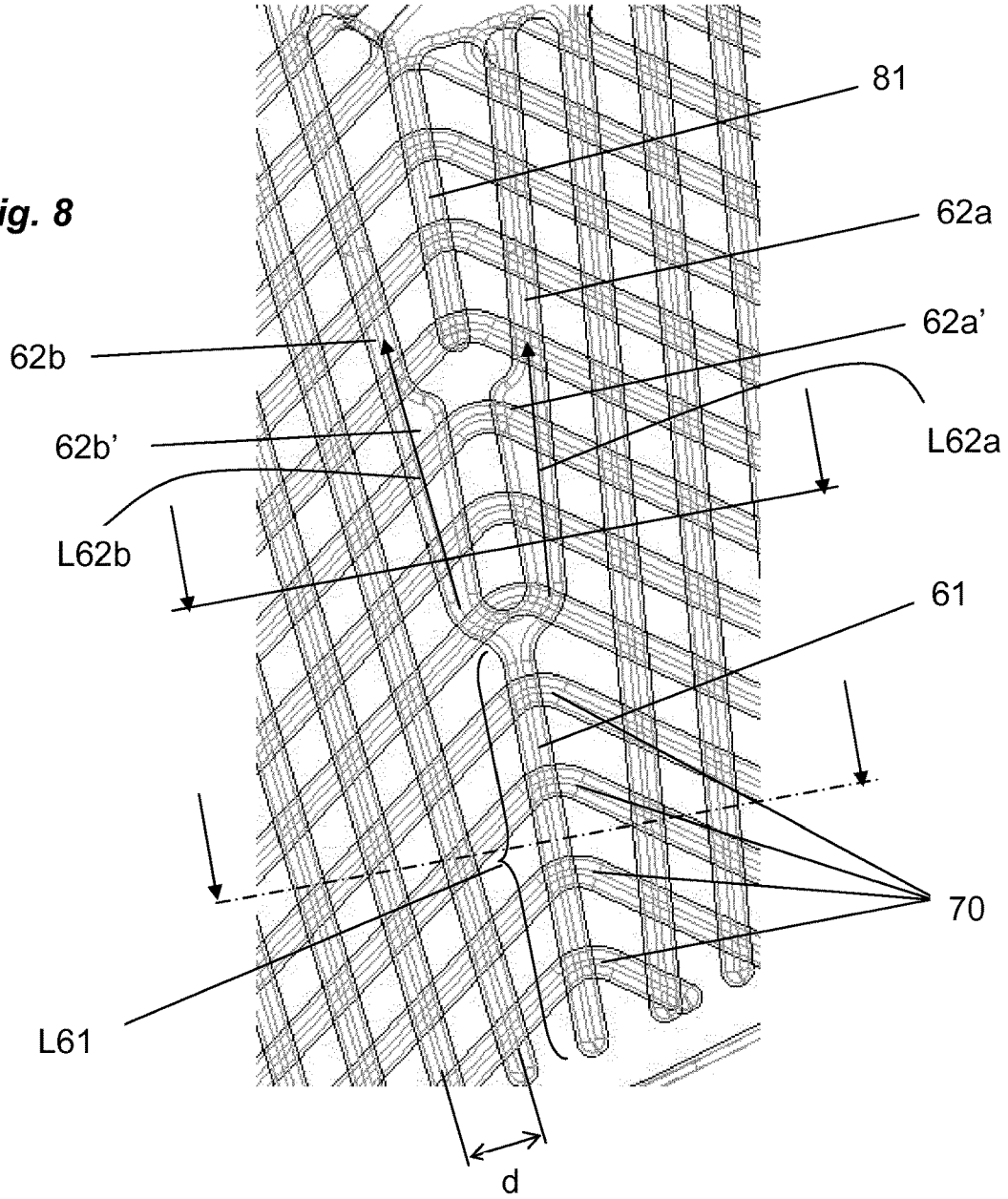
FIG. 8 is a view of a transition ridge abutting a plurality of consecutive chevron shaped ridge transitions of another plate.
Figure 9:
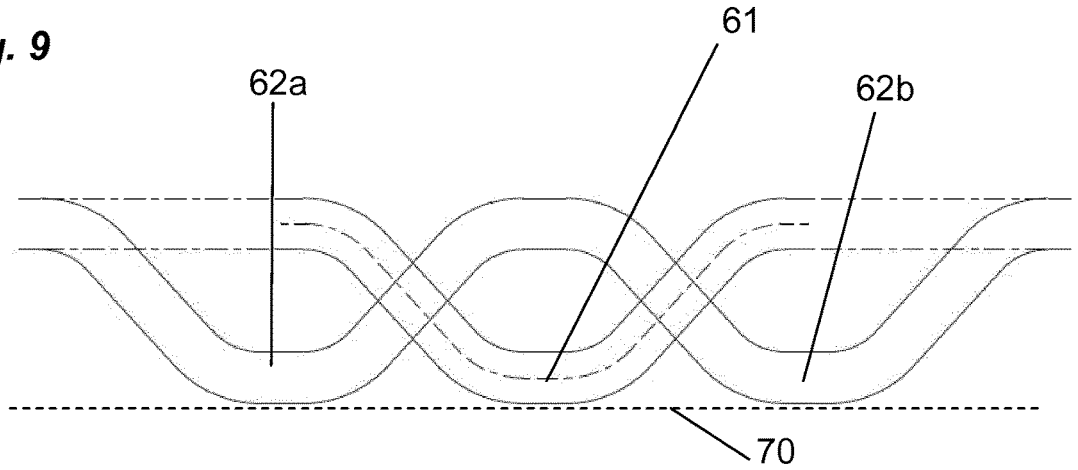
FIG. 9 discloses two cross-sections along the dash-dotted line respectively the solid line of FIG. 8.

As indicated in FIG. 4 and as shown in detail in FIG. 8, between two adjacent flow path sectors, such as 40*c*, 40*d* on the right hand side of FIGS. 4 and 40*a*, 40*c* on the left hand side of FIG. 4, having ridges extending at an angle relative to each other, a first transition ridge 60 is formed, in either the plates of the first or the second type, as a stem 61 branching off into two legs 62*a-b*.

As shown in FIG. 8, the stem 61 abuts a plurality, preferably at least three, and in FIG. 8 four, consecutive chevron shaped ridge transitions 70 of the other one of the first or second type of plates, the ridge transitions 70 being formed between the two adjacent flow path sectors having ridges extending at an angle relative to each other.

In FIG. 8 it is shown that the two legs 62*a*, 62*b* along its longitudinal extension L62*a*, L62*b* has a portion 62*a'*, 62*b'* with a locally enlarged width as seen in a direction transverse the longitudinal extension L62*a*, L62*b*.

A shown in FIG. 8, the first leg 62*a* extends in parallel with the ridges of its adjacent sector and the second leg 62*b* extends in parallel with the ridges of its adjacent sector.

A second transition ridge 80 may be formed as a stem branching off into two legs, wherein the stem of the second transition ridge 80 is arranged between the two legs of the first transition ridge. In the shown embodiment, the second transition ridge is only a stem 81.

It is contemplated that there are numerous modifications of the embodiments described herein, which are still within the scope of the invention as defined by the appended claims.

The locally enlarged width may for instance be formed on the stem 61 instead or as a complement to the locally enlarged width of the legs 62*a*, 62*b*.

The invention claimed is:

1. A plate package for a heat exchanger device, comprising:

a plurality of heat exchanger plates of a first type and a plurality of heat exchanger plates of a second type arranged alternatingly in the plate package one on top of the other, wherein each heat exchanger plate has a main extension plane which is substantially vertical when installed in the heat exchanger device, wherein the alternatingly arranged heat exchanger plates form first plate interspaces, which are substantially open and arranged to permit a flow of a medium to be evaporated there-through, and second plate interspaces, which are closed and arranged to permit a flow of a fluid for evaporating the medium, wherein each of the heat exchanger plates of the first type and of the second type has a first port opening at a lower portion of the plate package and a second port opening at an upper portion of the plate package, the first and second port openings being in fluid connection with the second plate interspaces, wherein the heat exchanger plates of the first type and of the second type further comprise mating abutment portions forming a fluid distributor in the respective second plate interspaces, wherein the fluid distributor has a longitudinal extension having a horizontal extension along a horizontal plane and being located as seen in a vertical direction in a position between the first port openings and the second port openings, thereby forming in the respective second plate interspaces two flow paths extending between the first port opening, around the fluid distributor, and the second port opening, wherein a first flow path of the two flow paths is divided into at least three flow path sectors arranged one after the other along the first flow path, wherein each of the heat exchanger plates of the first type and of the second type in each flow path sector comprises a plurality of mutually parallel ridges, wherein the ridges of the heat exchanger plates of the first and second types are oriented such that when the ridges abut each other the ridges form a chevron pattern relative to a main flow direction in the respective flow path sector, wherein respective ridges form an angle β being greater than 45° to the main flow direction in the respective flow path sector, wherein the ridges of each sector are at an angle to the ridges of an immediately adjacent sector, and wherein a first flow path sector of the at least three flow path sectors is arranged in the lower portion of the plate package, a second flow path sector of the at least three flow path sectors is arranged in the upper portion of the plate package, and a third flow path sector of the at least three flow path sectors is arranged in a transition between the upper and lower portions.

2. The plate package according to claim 1, wherein each flow path is divided into at least four sectors, wherein at least two of the at least four flow path sectors are arranged in the transition between the upper and lower portions.

3. The plate package according to claim 1, wherein the fluid distributor comprises a horizontally extending central portion and two wing portions extending upwardly and outwardly from either end of the central portion.

4. The plate package according to claim 1, wherein the fluid distributor is mirror symmetrical about a vertical plane extending transversely to the main extension planes and through centres of the first and second port openings.

5. The plate package according to claim 1, wherein a respective demarcation line between adjoining sectors extends from the fluid distributor outwardly towards an outer edge of the respective heat exchanger plate.

6. The plate package according to claim 5, wherein the main flow direction in the first sector extends from the inlet port to a central portion of a demarcation line between the first sector and an adjoining downstream sector, wherein a respective main flow direction in any flow path sector of the three flow path sectors extends from a central portion of a respective demarcation line between the sector and an adjoining upstream sector to a central portion of a respective demarcation line between the sector and an adjoining downstream sector, wherein the main flow direction in the second sector extends from a central portion of the demarcation line between the second sector and an adjoining upstream sector to the outlet port, and wherein the central portion of the respective demarcation line comprises a mid-point of the respective demarcation line and up to 15% of the length of the respective demarcation line on either side of the mid-point.

7. The plate package according to claim 1, wherein, between two adjacent flow path sectors having ridges extending at an angle relative to each other, a first transition ridge is formed, in either the plates of the first or the second type, as a stem branching off into two legs.

8. The plate package according to claim 7, wherein the stem abuts a plurality of consecutive chevron shaped ridge transitions of the other one of the first or second type of plates, the ridge transitions being formed between the two adjacent flow path sectors having ridges extending at an angle relative to each other.

9. The plate package according to claim 7, wherein at least one of the two legs and/or the stem along a longitudinal extension thereof has a portion with a locally enlarged width as seen in a direction transverse the longitudinal extension.

10. The plate package according to claim 7, wherein the first leg extends in parallel with the ridges of its adjacent sector and the second leg extends in parallel with the ridges of its adjacent sector.

11. The plate package according to claim 7, wherein a second transition ridge is formed as a stem wherein the stem of the second transition ridge is arranged between the two legs of the first transition ridge.

12. The plate package according to claim 1, wherein a respective demarcation line between adjoining sectors extends from the fluid distributor rectilinearly outwardly towards an outer edge of the respective heat exchanger plate.

13. The plate package according to claim 7, wherein the stem abuts at least three consecutive chevron shaped ridge transitions of the other one of the first or second type of plates, the ridge transitions being formed between the two adjacent flow path sectors having ridges extending at an angle relative to each other.

14. The plate package according to claim 7, wherein a second transition ridge is formed as a stem which branches off into two legs, wherein the stem of the second transition ridge is arranged between the two legs of the first transition ridge.

15. The plate package according to claim 2, wherein the fluid distributor comprises a horizontally extending central portion and two wing portions extending upwardly and outwardly from either end of the central portion.

16. The plate package according to claim 2, wherein the fluid distributor is mirror symmetrical about a vertical plane extending transversely to the main extension planes and through centres of the first and second port openings.

17. A heat exchanger device including a shell which forms a substantially closed inner space, comprising:

a plate package including a plurality of heat exchanger plates of a first type and a plurality of heat exchanger plates of a second type arranged alternatingly in the plate package one on top of the other, wherein each heat exchanger plate has a main extension plane and is substantially vertical when installed in the heat exchanger device, wherein the alternatingly arranged heat exchanger plates form first plate interspaces, which are substantially open and arranged to permit a flow of a medium to be evaporated there-through, and second plate interspaces, which are closed and arranged to permit a flow of a fluid for evaporating the medium, wherein each of the heat exchanger plates of the first type and of the second type has a first port opening at a lower portion of the plate package and a second port opening at an upper portion of the plate package, the first and second port openings being in fluid connection with the second plate interspaces, wherein the heat exchanger plates of the first type and of the second type further comprise mating abutment portions forming a fluid distributor in the respective second plate interspaces, wherein the fluid distributor has a longitudinal extension having a horizontal extension along a horizontal plane and being located as seen in a vertical direction in a position between the first port openings and the second port openings, thereby forming in the respective second plate interspaces two flow paths extending between the first port opening, around the fluid distributor, and to the second port opening, wherein a first flow path of the two flow paths is divided into at least three flow path sectors arranged one after the other along the first flow path, wherein each of the heat exchanger plates of the first type and of the second type in each flow path sector comprises a plurality of mutually parallel ridges, wherein the ridges of the heat exchanger plates of the first and second types are oriented such that when the ridges abut each other the ridges form a chevron pattern relative to a main flow direction in the respective flow path sector, wherein a respective ridge forms an angle $\beta$ being greater than 45° to the main flow direction in a respective flow path sector, wherein the ridges of each sector are at an angle to the ridges of an immediately adjacent sector, and wherein a first flow path sector of the at least three flow path sectors is arranged in the lower portion of the plate package, a second flow path sector of the at least three flow path sectors is arranged in the upper portion of the plate package, and a third flow path sector of the at least three flow path sectors is arranged in a transition between the upper and lower portions.

* * * * *